United States Patent [19]

Hallén

[11] 4,162,545

[45] Jul. 31, 1979

[54] SINK FOR WASH-BASINS, DRAINBOWLS AND THE LIKE

[76] Inventor: Jan-Äke Hallén, Brinketorpsvägen 3, Partille, Sweden, 433 00

[21] Appl. No.: 848,303

[22] Filed: Nov. 3, 1977

Related U.S. Application Data

[63] Continuation of Ser. No. 696,182, Jun. 15, 1976, abandoned.

[30] Foreign Application Priority Data

Jun. 17, 1975 [SE] Sweden ..... 7506914

[51] Int. Cl.[2] ..... E03C 1/26

[52] U.S. Cl. ..... 4/190

[58] Field of Search ..... 4/187 R, 189, 190, 290, 4/291, 292

[56] References Cited

U.S. PATENT DOCUMENTS

| | | | |
|---|---|---|---|
| 471,578 | 3/1892 | Strater | 4/189 |
| 858,628 | 7/1907 | Ross | 4/187 R |
| 1,641,061 | 8/1927 | Young | 4/190 X |

*Primary Examiner*—Richard E. Aegerter
*Assistant Examiner*—Frederick R. Schmidt
*Attorney, Agent, or Firm*—Holman & Stern

[57] ABSTRACT

A sink which is easily built-in into a rather small place is proposed. The sink is rather shallow and is provided with a detachably fitted close meshed splash guard lattice which is provided with a number of walls subdividing the lattice in a number of openings. The sink is in its bottom provided with a drain designed to fit with a connecting socket of a drainage system.

4 Claims, 4 Drawing Figures

SINK FOR WASH-BASINS, DRAINBOWLS AND THE LIKE

This is a continuation of application Ser. No. 696,182, filed June 15, 1976 now abandoned.

BACKGROUND OF THE INVENTION

The present invention refers to a sink for wash-basins, drainbowls and the like and it is particularly suited for doctor's and dentist's offices, where there is a great demand for frequent hand washes.

Washing devices have hitherto, almost with no exceptions, been non-detachably mounted to a wall directly adjacent an existing, permanent drain and where supply pipes for hot and cold water are present. The wash basin hereby has been located at a position which has been entirely decided only by the prevailing conditions and without any connection to the activities which take place in the room. This has had to result that the wash basin in several cases has been located inconveniently from an economic point of view. A contributory cause to this has been that the wash basin due to its depth occupies a disproportionally large place, and in view of this has it been difficult or even impossible to arrange it in connection to the activity where the washing is required. Another drawback at known wash basins is the large risk for water splashs around the basin, and it has been considered due to this risk that a patient shall not be placed in close vicinity of the wash basin.

SUMMARY OF THE INVENTION

The purpose of the present invention is to eliminate the above mentioned disadvantages and to provide a sink which has a very small building in height, which solves the problem with water splashs and which is furthermore very easily cleaned and if desired also easily sterilized. This problem has been solved by a sink including a troughshaped vessel having a drainage opening located at its lowest part, a splash-guard detachably fitted at the upper part of the sink and extending over substantially the entire opening thereof, said splash-guard being formed by a close meshed lattice having thin intermediate walls forming the lattice openings.

DESCRIPTION OF THE PREFERRED EMBODIMENT

Figure 2:
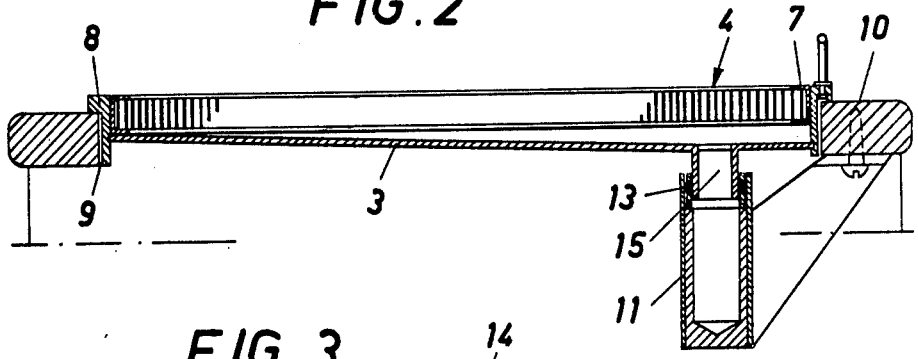
FIG. 2 is a section along line II—II in FIG. 1.
Figure 3:
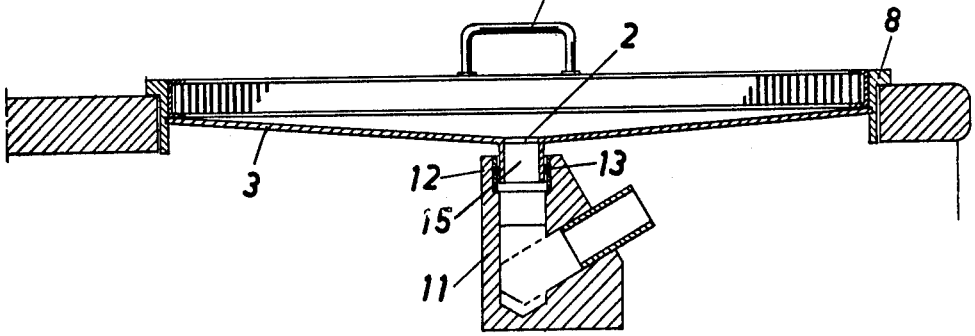
FIG. 3 is a section along line III—III in FIG. 1.
Figure 1:
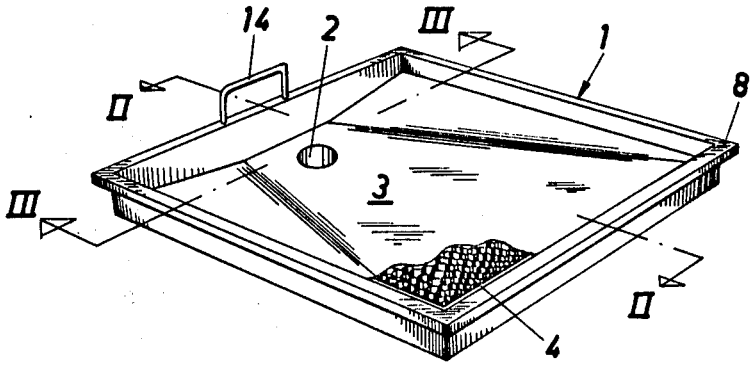
FIG. 1 shows in perspective a sink according to the invention.
Figure 4:
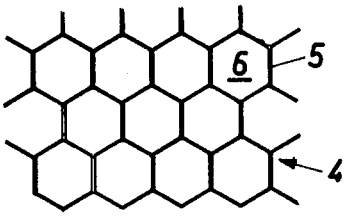
FIG. 4 shows in a view from above and in larger scale a portion of a lattice belonging to the sink.

The new sink according to the invention comprises a very shallow, preferably rectangular trough-formed vessel 1 having a bottom 3, which slopes against a drain 2. The bottom is arranged at an invariable level along two of the side edges of the vessel, and these bottom portions support a splash guard 4, which extends over substantially the entire opening of the vessel and consists of a comparatively close meshed lattice. The lattice—as can be seen in FIG. 4—is provided with thin-walled intermediate walls 5 between the openings 6 of the lattice. The depth of the lattice openings preferably is chosen to be larger than or at least equal to their diameter, thereby effecting that a jet of water, which hits the lattice will be subdivided into parallel smaller jets whereby splashs will be eliminated.

The outer end surface of the intermediate walls 5 could possibly be provided with a sharp edge which still more would contribute to the elimination of splashs. In order to make possible manufacture of a lattice having as thin intermediate walls as possible the lattice openings 6 are preferably made with hexagonal cross-section and the entire lattice is in the form of a honeycomb. The lattice is preferably surrounded by a frame 7, which also facilitates the fitting and removal of the lattice to and from the sink.

At the upper edge of the sink 1 there is provided a flange 8, which extends around the sink and forms a rim to be supported when the sink is lowered into an aperture 9 in a work bench 10. The work bench is provided with a fixed drain tap 11 positioned just below the drain 2 of the sink, and having a connecting socket 12, which at its internal side is provided with a sealing ring 13. The sink 1 is provided with a corresponding drainage connecting piece 15, and it is furthermore preferably provided with a handle 14 at one of its sides. This handle makes it possible to lift up the sink 1 from the aperture 9 in the bench plate 10 when the sink shall be cleaned and if desired also sterilized. Due to the fact that the drain tap 11 has a fixed position in relation to the bench plate, is it possible after cleaning of the lattice and the sink, to reinsert the latter in the aperture, whereby the drainage connecting piece 15 will enter into the connecting socket 12. To minimize the amount of room taken vertically by the shallow sink, the smallest depth of the sink, i.e., the shallowest portion, should be substantially equal to the depth of the lattice.

What I claim is:

1. In a sink intended to be used for wash-basins, drainbowls and the like including a trough-shaped vessel having a drainage opening located at its lowest part, a splash-guard detachable fitted at the upper part of the sink and extending over substantially the entire opening thereof, the improvement comprising said splash-guard being formed by a closed meshed lattice having thin parallel intermediate walls forming the lattice openings said intermediate walls having an extension larger than or at least equal to the largest cross-sectional measure of said lattice openings in a direction perpendicular to the plane of the upper surface of the sink and the lattice being substantially as deep as the smallest depth of the vessel.

2. The improvement as claimed in claim 1, wherein the lattice is surrounded and supported by a frame.

3. The improvement as claimed in claim 1, wherein the vessel and/or the lattice consists of a material which can be sterilized.

4. In a sink intended to be used for wash-basins, drainbowls and the like comprising a trough-shaped vessel, a drainage opening provided in the bottom thereof, a drain connecting piece fitted to said drainage opening and extending outside the vessel, said drain connecting piece being adapted sealingly and detachably to fit into a connecting socket of a drain tap provided at a work bench where the sink is intended to be placed in an aperture, a lattice forming a splash-guard being provided at the upper part of the vessel, the improvement comprising said lattice being formed with a plurality of thin parallel intermediate walls defining a closed mesh lattice having a number of lattice openings, the openings of said lattice having a largest cross-sectional measure which is at most equal to the depth of the lattice openings, the lattice further being substantially as deep as the smallest depth of the vessel, a frame surrounding and supporting the lattice on the vessel, and a handle provided at the vessel for allowing this to be easily removed from the said aperture, the vessel and/or the lattice being made of a material which can be made sterile.

* * * * *